US011482786B2

(12) United States Patent
Kwak et al.

(10) Patent No.: US 11,482,786 B2
(45) Date of Patent: Oct. 25, 2022

(54) ANTENNA APPARATUS

(71) Applicant: Samsung Electro-Mechanics Co., Ltd., Suwon-si (KR)

(72) Inventors: Eunhyuk Kwak, Suwon-si (KR); Won Wook So, Suwon-si (KR); Juhyoung Park, Suwon-si (KR); Daeki Lim, Suwon-si (KR); Jeongki Ryoo, Suwon-si (KR); Nam Ki Kim, Suwon-si (KR); Woncheol Lee, Suwon-si (KR); Hyungjin Lee, Suwon-si (KR); Dongok Ko, Suwon-si (KR); Jaemin Keum, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 35 days.

(21) Appl. No.: 17/116,228

(22) Filed: Dec. 9, 2020

(65) Prior Publication Data

US 2022/0077584 A1 Mar. 10, 2022

(30) Foreign Application Priority Data

Sep. 8, 2020 (KR) ..... 10-2020-0114788

(51) Int. Cl.

| | |
|---|---|
| ***H01Q 1/22*** | (2006.01) |
| ***H01Q 9/04*** | (2006.01) |
| ***H01Q 1/38*** | (2006.01) |

(52) U.S. Cl.

CPC ..... *H01Q 9/0407* (2013.01); *H01Q 1/2283* (2013.01); *H01Q 1/38* (2013.01)

(58) Field of Classification Search

CPC ..... H01Q 9/0407; H01Q 1/38
USPC ..... 340/700 MS
See application file for complete search history.

(56) References Cited

U.S. PATENT DOCUMENTS

| | | | | |
|---|---|---|---|---|
| 2013/0234907 | A1 | 9/2013 | Yoo | |
| 2013/0234911 | A1 | 9/2013 | Lee | |
| 2017/0133763 | A1* | 5/2017 | Suzuki | H01Q 1/50 |
| 2017/0365918 | A1* | 12/2017 | Kaneko | H01Q 1/523 |

FOREIGN PATENT DOCUMENTS

| | | |
|---|---|---|
| KR | 10-2013-0102169 A | 9/2013 |
| KR | 10-2013-0102170 A | 9/2013 |

* cited by examiner

*Primary Examiner* — Peguy Jean Pierre
(74) *Attorney, Agent, or Firm* — NSIP Law

(57) ABSTRACT

An antenna apparatus includes a ground layer and an antenna patch overlapping via a dielectric layer therebetween, a first feed via and a second feed via penetrating at least a portion of the dielectric layer, a power supply line connected to the first feed via, and a coupling pattern disposed adjacent to the power supply line and coupled with the power supply line.

20 Claims, 10 Drawing Sheets

ANTENNA APPARATUS

CROSS-REFERENCE TO RELATED APPLICATIONS

This application claims the benefit under 35 USC 119(a) of Korean Patent Application No. 10-2020-0114788 filed in the Korean Intellectual Property Office on Sep. 8, 2020, the entire disclosure of which is incorporated herein by reference for all purposes.

BACKGROUND

1. Field

The present disclosure relates to an antenna apparatus.

2. Description of the Background

Recently, millimeter wave (mmWave) communication including 5th generation communication has been actively researched, and research for commercialization/standardization of an antenna device that smoothly implements it has been actively conducted.

Radio Frequency (RF) signals of high frequency bands, for example, 24 GHz, 28 GHz, 36 GHz, 39 GHz, and 60 GHz, may be easily lost in a process of being transmitted, and the signals may be lost due to a collision with harmonics components of the RF signal in a low frequency band. Accordingly, communication quality may deteriorate.

Meanwhile, as a portable electronic device develops, a size of a screen, which is a display area of the electronic device, increases, and accordingly, a size of the bezel, which is a non-display area in which an antenna and the like are disposed, decreases, such that a size of an area in which the antenna can be installed also decreases.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a ground layer and an antenna patch overlapping via a dielectric layer therebetween, a first feed via and a second feed via penetrating at least a portion of the dielectric layer, a power supply line connected to the first feed via, and a coupling pattern disposed adjacent to the power supply line and coupled with the power supply line.

A signal of a first frequency band may be received and transmitted by an electrical signal applied to the first feed via, a signal of a second frequency band may be received and transmitted by an electrical signal applied to the second feed via, and a center frequency of the first frequency band may be lower than a center frequency of the second frequency band.

A resonance frequency caused by coupling of the power supply line and the coupling pattern may be matched with the second frequency band.

The resonance frequency caused by the coupling of the power supply line and the coupling pattern may be a harmonics frequency of the first frequency band.

The antenna apparatus may further include a first ground layer separated from the ground layer, and the coupling pattern may be connected to the first ground layer.

The coupling pattern may be disposed adjacent to a side of an end of the power supply line.

The coupling pattern may be disposed to be parallel to the power supply line.

In another general aspect, an antenna apparatus includes a ground layer and an antenna patch overlapping via a dielectric layer therebetween, a first feed via and a second feed via penetrating at least part of the dielectric layer, and a coupling pattern disposed at a side of the first feed via and coupled with the first feed via, wherein a signal of a first frequency band is received and transmitted by an electrical signal applied to the first feed via, a signal of a second frequency band is received and transmitted by an electrical signal applied to the second feed via, and a center frequency of the first frequency band is lower than a center frequency of the second frequency band.

The coupling pattern may be connected to the ground layer.

A height of the first feed via may be greater than a height of the ground layer based on the coupling pattern.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
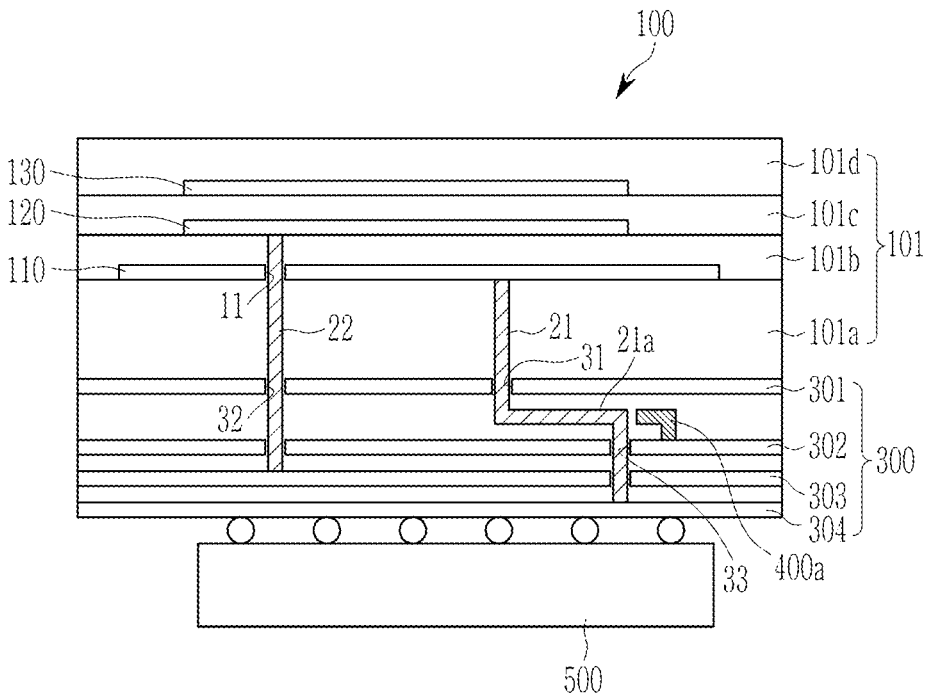
FIG. 1 is a schematic cross-sectional view of an antenna apparatus according to one or more example embodiments.

Hereinafter, while examples of the present disclosure will be described in detail with reference to the accompanying drawings, it is noted that examples are not limited to the same.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or less than the whole element.

As used herein, the term "and/or" includes any one and any combination of any two or more of the associated listed items; likewise, "at least one of" includes any one and any combination of any two or more of the associated listed items.

Throughout the specification, the phrase "on a plane" means viewing the object portion from the top, and the phrase "on a cross-section" means viewing a cross-section of which the object portion is vertically cut from the side.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms, such as "above," "upper," "below," "lower," and the like, may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above," or "upper" relative to another element would then be "below," or "lower" relative to the other element. Thus, the term "above" encompasses both the above and below orientations depending on the spatial orientation of the device. The device may also be oriented in other ways (rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

Herein, it is noted that use of the term "may" with respect to an example, for example, as to what an example may include or implement, means that at least one example exists in which such a feature is included or implemented while all examples are not limited thereto.

The features of the examples described herein may be combined in various ways as will be apparent after an understanding of this disclosure. Further, although the examples described herein have a variety of configurations, other configurations are possible as will be apparent after an understanding of this disclosure.

Example embodiments disclosed herein describe a multi-band antenna apparatus having improved performance and that is capable of being down-sized.

An antenna apparatus 100 according to one or more example embodiments is described with reference to FIG. 1 and FIG. 2. FIG. 1 is a schematic cross-sectional view of an antenna apparatus according to one or more example embodiments, and FIG. 2 is a perspective view showing one or more example embodiments of a part of an antenna apparatus of FIG. 1.

Figure 2:
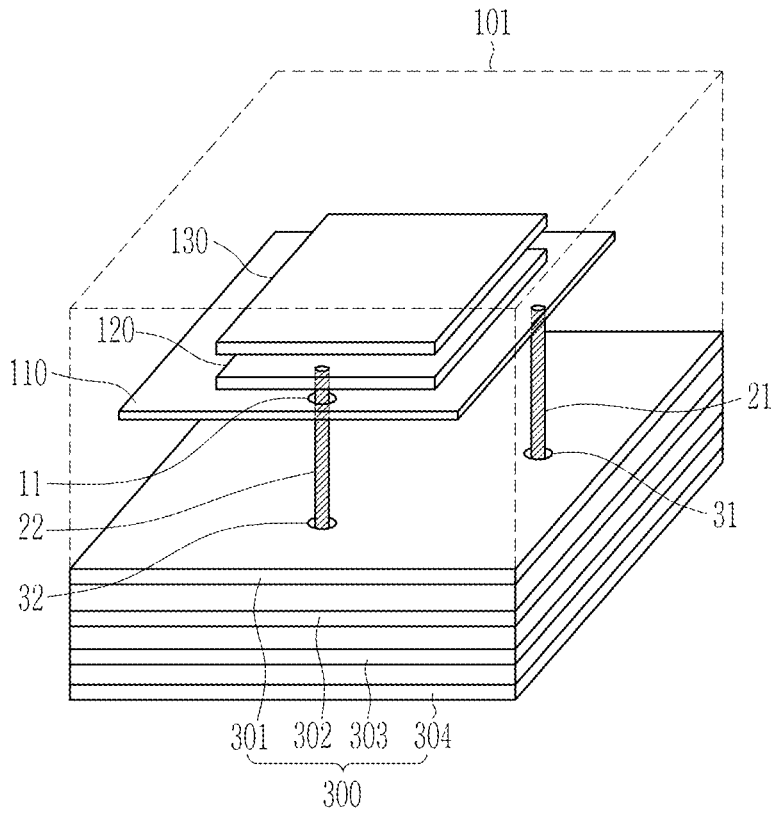
FIG. 2 is a perspective view showing one or more example embodiments of a part of an antenna apparatus of FIG. 1.

Referring to FIG. 1 and FIG. 2, the antenna apparatus 100 according to one or more example embodiments includes a dielectric layer 101 including a plurality of dielectric layers 101*a*, 101*b*, 101*c*, and 101*d*, a connection part 300 including a plurality of ground layers 301 and 302 and a plurality of metal layers 303 and 304, and an electrical element 500 connected to the connection part 300.

The antenna apparatus 100 according to one or more example embodiments includes a first antenna patch 110, a second antenna patch 120, a third antenna patch 130, a first feed via 21 connected to the first antenna patch 110, a second feed via 22 connected to the second antenna patch 120, and a ground pattern 400*a* (coupling pattern) disposed adjacent to a power supply line 21*a* connected to the first feed via 21.

The first antenna patch 110 of the antenna apparatus 100 is disposed on the first dielectric layer 101*a* among the plurality of dielectric layers 101*a*, 101*b*, 101*c*, and 101*d*, and the first antenna patch 110 is disposed to face the first ground layer 301 among the plurality of ground layers 301 and 302 of the connection part 300 via the first dielectric layer 101*a*. The second antenna patch 120 is disposed on the second dielectric layer 101*b* disposed on the first dielectric layer 101*a*, the third antenna patch 130 is disposed on the third dielectric layer 101*c* disposed on the second antenna patch 120, and the fourth dielectric layer 101*d* is disposed on the third antenna patch 130.

The first antenna patch 110 of the antenna apparatus 100 may receive an electrical signal from the first feed via 21, and the second antenna patch 120 of the antenna apparatus 100 may receive an electrical signal from the second feed via 22.

The first feed via 21 and the second feed via 22 may be connected to any one among a plurality of layers of the connection part 300 by passing through a first ground layer 301 through a first through-hole 31 and a second through-hole 32 formed in the first ground layer 301, and may receive the electrical signal from the electrical element 500 connected to the connection part 300 to transmit it.

The first feed via 21 among the first feed via 21 and the second feed via 22 may transmit the electrical signal to the first antenna patch 110, and the second feed via 22 may transmit the electrical signal to the second antenna patch 120 without being in contact with the first antenna patch 110 through a through-hole 11 formed in the first antenna patch 110.

The ground pattern 400*a* disposed adjacent to a power supply line (strip) 21*a* connected to the first feed via 21 is connected to the second ground layer 302 of the connection part 300 and acts as a movement passage of an unnecessary frequency component caused by the coupling with the power supply line 21*a* connected to the first feed via 21, thereby removing or reducing a noise frequency component.

When the electrical signal is transmitted to the first feed via 21 and the second feed via 22 from the electrical element 500, the electrical signal is transmitted to the first antenna patch 110 and the second antenna patch 120 through the first feed via 21 and the second feed via 22, and the first antenna patch 110 and the second antenna patch 120 may receive an RF signal through the coupling with the first ground layer 301. In this case, the third antenna patch 130 may improve a gain and bandwidth of the RF signal of the antenna apparatus 100 through additional coupling with the first antenna patch 110 and the second antenna patch 120.

For example, the antenna apparatus 100 may transmit and receive an RF signal of a first frequency band through the electrical signal transmitted from the first feed via 21 and may transmit and receive an RF signal of a second frequency band through the electrical signal transmitted from the second feed via 22. The center frequency of the first frequency band may be lower than the center frequency of the second frequency band. In this way, the antenna apparatus 100 may transmit and receive a low frequency RF signal through the electrical signal transmitted from the first feed via 21 and may transmit and receive a high frequency band RF signal through the electrical signal transmitted from the second feed via 22, and thereby the antenna apparatus 100 may transmit and receive multi-band RF signals.

A harmonics component of the low frequency RF signal of the antenna apparatus 100 that transmits and receives the multi-band RF signal may occur, and the harmonics component of the low frequency RF signal may affect the high frequency RF signal of the antenna apparatus 100. However, according to the antenna apparatus 100 of the example embodiments described herein, by including the ground pattern 400*a* disposed adjacent to the power supply line 21*a* connected to the first feed via 21 for transmitting the electrical signal for transmission and reception of the low frequency RF signal, as the power supply line 21*a* connected to the first feed via 21 and the ground pattern 400*a* are coupled to form a parasitic resonance, the harmonics component of the low frequency RF signal is transmitted to the second ground layer 302, thereby removing or reducing the harmonics component of the low frequency RF signal that may cause interference with the high frequency RF signal.

In the shown example embodiment, the dielectric layer 101 includes four dielectric layers 101*a*, 101*b*, 101*c*, and 101*d* and three antenna patches 110, 120, and 130, however example embodiments are not limited thereto, and it is evident that the number of dielectric layers, the thickness, and the number and position of the antenna patches, may be changed.

In the illustrated example embodiments, the connection part 300 includes two ground layers 301 and 302 and two metal layers 303 and 304, but the example embodiments are not limited thereto, and it is evident that the number and position of each layer in the connection part 300 may be changed.

In the illustrated example embodiments, the antenna apparatus 100 includes the first antenna patch 110, the second antenna patch 120, and the third antenna patch 130, but example embodiments are not limited thereto, and it is evident that the number of antenna patches, and a planar shape and size of the antenna patches, may be changed according to the frequency characteristic of the antenna apparatus.

In the illustrated example embodiments, the first feed via 21 is connected to the first antenna patch 110 and the second feed via 22 is connected to the second antenna patch 120, but the example embodiments are not limited thereto, and the first feed via 21 and the second feed via 22 may be spaced apart from the first antenna patch 110 and the second antenna patch 120 and may transmit the electrical signal by coupling with the first antenna patch 110 and the second antenna patch 120.

Figure 3:
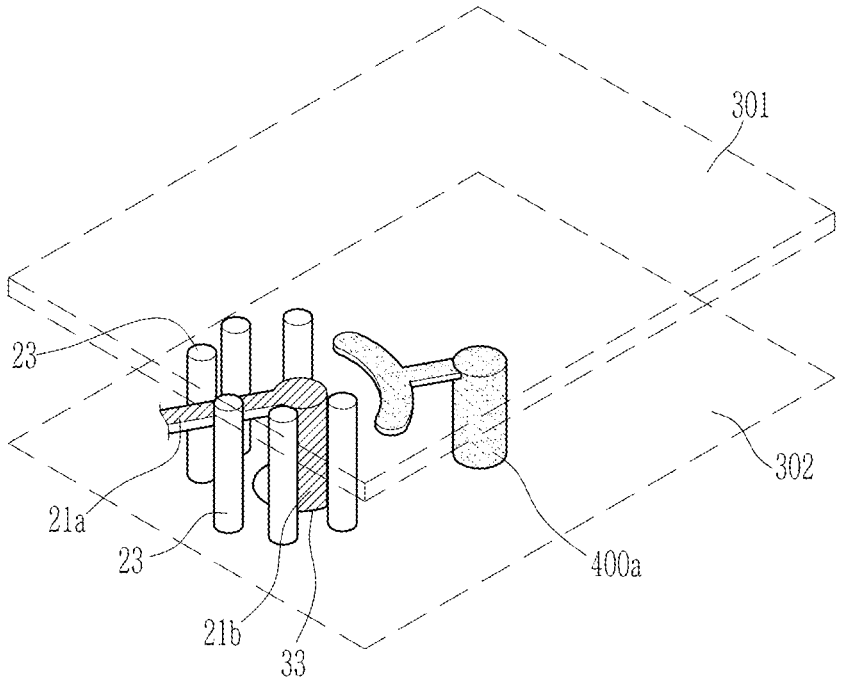
FIG. 3 is a perspective view showing one or more example embodiments of a part of an antenna apparatus of FIG. 1.
Figure 4:
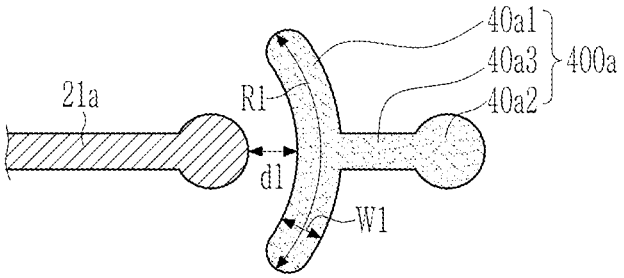
FIG. 4 is a top plan view showing a part of an antenna apparatus according to one or more example embodiments.

Now, the ground pattern 400*a* of the antenna apparatus 100 according to one or more example embodiments is described in more detail with reference to FIG. 3 and FIG. 4. FIG. 3 is a perspective view showing one or more examples of a part of an antenna apparatus of FIG. 1, and FIG. 4 is a top plan view showing a part of an antenna apparatus according to one or more example embodiments.

Referring to FIG. 3, the power supply line 21*a* connected to the first feed via 21 transmitting the electrical signal for transmitting and receiving the low frequency RF includes a longitudinal part 21*b* connected to a conductive layer disposed under the second ground layer 302 through a through-hole 33 of the second ground layer 302, and may receive the electrical signal through the longitudinal part 21*b*.

A plurality of shielding parts 23 connected to the first ground layer 301 and the second ground layer 302 are disposed around the power supply line 21*a*, and the electrical signal applied to the power supply line 21*a* may be prevented from being spread to the outside by the shielding parts 23.

The ground pattern 400*a* is disposed on one side of the end of the power supply line 21*a*. The ground pattern 400*a* includes a coupling part 40*a*1 disposed at the side of the power supply line 21*a*, a grounding part 40*a*2 connected to the second ground layer 302, and a connection part 40*a*3 connecting the coupling part 40*a*1 and the grounding part 40*a*2.

When the electrical signal is applied to the power supply line 21*a*, the coupling part 40*a*1 of the ground pattern 400*a* disposed adjacent to the power supply line 21*a* is coupled to the power supply line 21*a*, thereby generating the parasitic resonance. The parasitic resonance component between the power supply line 21*a* and the ground pattern 400*a* is the harmonics component of the resonance frequency band generated between the first antenna patch 110 and the first ground layer 301 by the electrical signal applied to the first feed via 21, and may be a resonance matched with the resonance frequency band that occurs between the second antenna patch 120 and the first ground layer 301 by the electrical signal applied to the second feed via 22.

Referring to FIG. 4, by adjusting an interval d1 between the coupling part 40*a*1 of the ground pattern 400*a* and the power supply line 21*a*, and a length R1 and a width W1 of the coupling part 40*a*1 of the ground pattern 400*a*, the frequency band of the parasitic resonance component between the power supply line 21*a* and the ground pattern 400*a* may be adjusted, thereby the parasitic resonance component between the power supply line 21*a* and the ground pattern 400*a* may be matched with the resonance frequency band generated between the second antenna patch 120 and the first ground layer 301 by the electrical signal applied to the second feed via 22.

The parasitic resonance component depending on the coupling between the power supply line 21*a* and the ground pattern 400*a* passes to the second ground layer 302 through the grounding part 40*a*2 of the ground pattern 400*a*, thereby eliminating or reducing the effect on the resonance frequency band between the second antenna patch 120 and the first ground layer 301.

In general, in order to remove the harmonics component of the resonance frequency of the low frequency band, a low pass filter is added to a low frequency power supply unit, or an additional antenna patch that may generate an additional resonance with the antenna patch generating the resonance frequency of the low frequency band may be disposed.

However, when the low pass filter is added to the power supply unit, a loss of the signal applied to the power supply unit may occur and then the performance of the antenna apparatus may be deteriorated, and when disposing the additional antenna patch, the size of the antenna apparatus increases and it may affect a radiation pattern of the antenna apparatus and then the performance of the antenna apparatus may be deteriorated.

According to the antenna apparatus of the example embodiments described herein, by including the ground pattern coupled adjacent to the power supply line, the harmonics component of the low frequency RF signal may be prevented from causing interference to the high frequency RF signal without increasing the size of the antenna apparatus or deteriorating the antenna performance.

Figure 5:
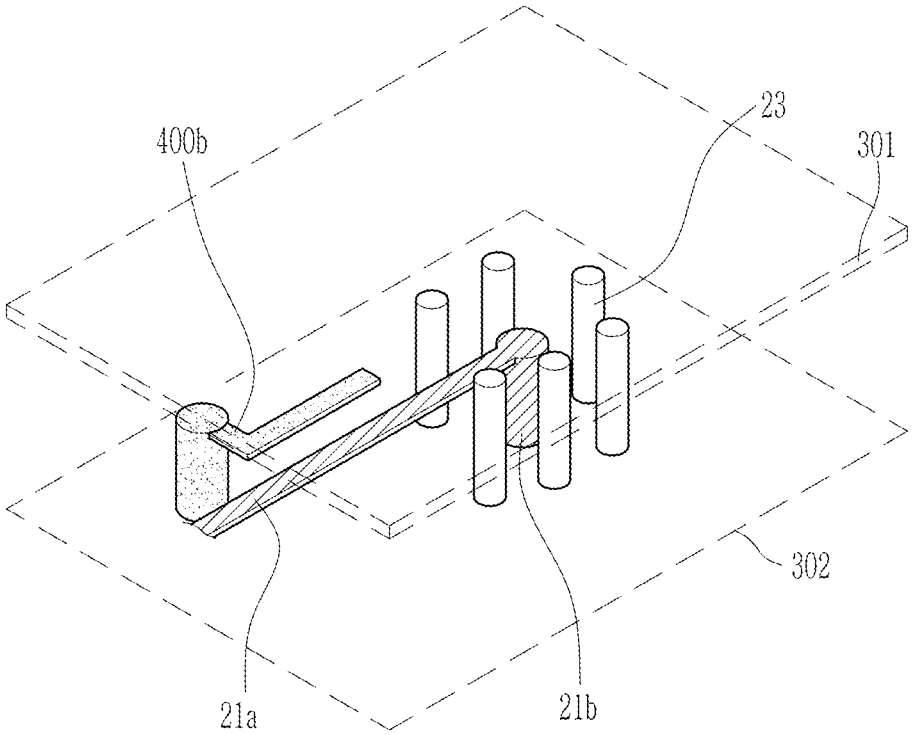
FIG. 5 is a perspective view showing one or more example embodiments of a part of an antenna apparatus of FIG. 1.
Figure 6:
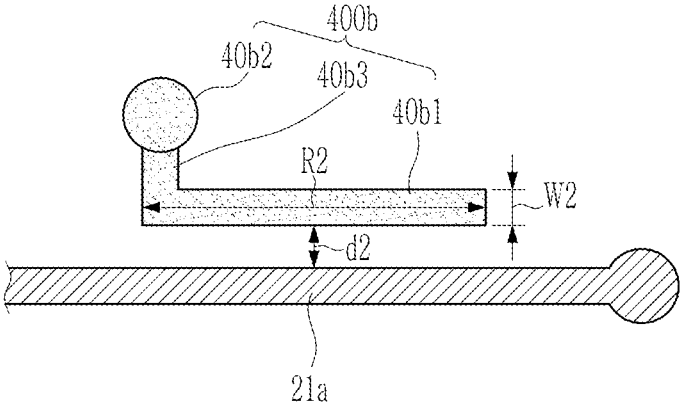
FIG. 6 is a top plan view showing a part of an antenna apparatus according to one or more example embodiments.

Next, a ground pattern 400*b* (coupling pattern) of the antenna apparatus according to another one or more example embodiments is described with reference to FIG. 5 and FIG. 6. FIG. 5 is a perspective view showing one or more example embodiments of a part of an antenna apparatus of FIG. 1, and FIG. 6 is a top plan view showing a part of an antenna apparatus according to one or more example embodiments.

Referring to FIG. 5, the power supply line 21*a* connected to the first feed via 21 transmitting the low frequency electrical signal includes a longitudinal part 21*b* connected to a conductive layer disposed under the second ground layer 302 through a through-hole 33 formed in the second ground layer 302, and may receive the electrical signal through the longitudinal part 21*b*.

The plurality of shielding parts 23 connected to the first ground layer 301 and the second ground layer 302 are disposed around the longitudinal part 21*b* of the power supply line 21*a*, thereby the shielding parts 23 prevent the electrical signal applied to the power supply line 21*a* from being diffused to the outside.

The ground pattern 400*b* that extends parallel to the power supply line 21*a* is disposed at a side of the power supply line 21*a*. The ground pattern 400*b* includes a coupling part 40*b*1 disposed at the side of the power supply line 21*a* and extending parallel to the power supply line 21*a*, a grounding part 40*b*2 connected to the second ground layer 302, and a connection part 40*b*3 connecting the coupling part 40*b*1 and the grounding part 40*b*2.

When the electrical signal is applied to the power supply line 21*a*, the coupling part 40*b*1 of the ground pattern 400*b* disposed adjacent to the power supply line 21*a* is coupled to the power supply line 21*a*, thereby generating the parasitic resonance. The parasitic resonance component between the power supply line 21*a* and the ground pattern 400*b* is the harmonics component of the resonance frequency band generated between the first antenna patch 110 and the first ground layer 301 by the electrical signal applied to the first feed via 21, and may be a resonance matched with the resonance frequency band that occurs between the second antenna patch 120 and the first ground layer 301 by the electrical signal applied to the second feed via 22.

Referring to FIG. 6, by adjusting the interval d2 between the coupling part 40*b*1 of the ground pattern 400*b* and the power supply line 21*a*, and the length R2 and the width W2 of the coupling part 40*b*1 of the ground pattern 400*b*, the frequency band of the parasitic resonance component between the power supply line 21*a* and the ground pattern 400*b* may be adjusted, thereby the parasitic resonance component between the power supply line 21*a* and the ground pattern 400*b* may be matched with the resonance frequency band generated between the second antenna patch 120 and the first ground layer 301 by the electrical signal applied to the second feed via 22.

According to the antenna apparatus of the example embodiments described herein, by including the ground pattern coupled adjacent to the power supply line, it is possible to prevent the harmonics component of the low frequency RF signal from generating the interference to the high frequency RF signal without increasing the size of the antenna apparatus or deteriorating the performance of the antenna apparatus.

Figure 7:
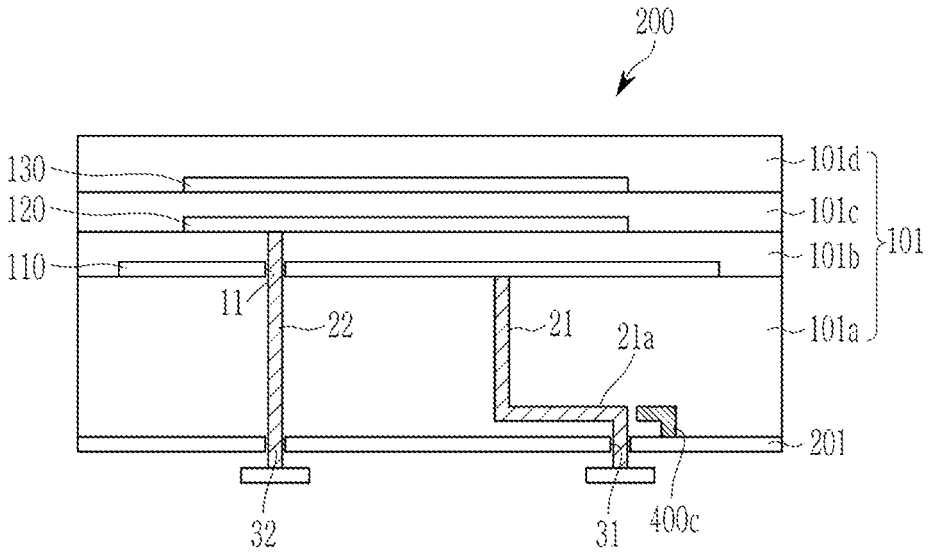
FIG. 7 is a schematic cross-sectional view of an antenna apparatus according to another one or more example embodiments.

Next, an antenna apparatus 200 according to another one or more example embodiments is described with reference to FIG. 7, FIG. 8, and FIG. 9. FIG. 7 is a schematic cross-sectional view of an antenna apparatus according to another one or more example embodiments, FIG. 8 is a perspective view of one or more example embodiments of a part of an antenna apparatus of FIG. 7, and FIG. 9 is a top plan view of a part of an antenna apparatus of FIG. 7 according to one or more example embodiments.

Figure 8:
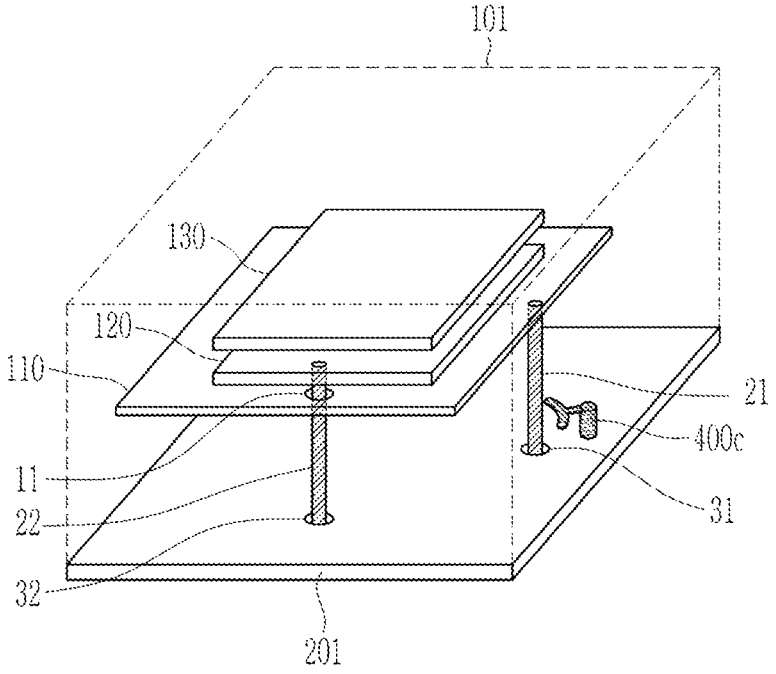
FIG. 8 is a perspective view of one or more example embodiments of a part of an antenna apparatus of FIG. 7.
Figure 9:
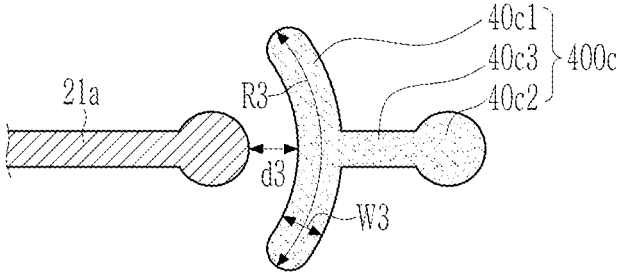
FIG. 9 is a top plan view of a part of an antenna apparatus of FIG. 7 according to one or more example embodiments.

Referring to FIG. 7 and FIG. 8, the antenna apparatus 200 according to one or more example embodiments includes a dielectric layer 101 disposed on a ground layer 201 and including a plurality of dielectric layers 101*a*, 101*b*, 101*c*, and 101*d*, a first antenna patch 110, a second antenna patch 120, and a third antenna patch 130, facing the ground layer 201 via at least part of the dielectric layer 101, a first feed via 21 connected to the first antenna patch 110, a second feed via 22 connected to the second antenna patch 120, and a ground pattern 400*c* (coupling pattern) disposed adjacent to the first feed via 21.

The first antenna patch 110 of the antenna apparatus 200 is disposed on the first dielectric layer 101*a* among the plurality of dielectric layers 101*a*, 101*b*, 101*c*, and 101*d*, and the first antenna patch 110 is disposed to face the ground layer 201 via the first dielectric layer 101*a*. The second antenna patch 120 is disposed on the second dielectric layer 101*b* disposed on the first dielectric layer 101*a*, the third antenna patch 130 is disposed on the third dielectric layer 101*c* disposed on the second antenna patch 120, and the fourth dielectric layer 101*d* is disposed on the third antenna patch 130.

The first antenna patch 110 of the antenna apparatus 200 may receive the electrical signal from the first feed via 21, and the second antenna patch 120 of the antenna apparatus 200 may receive the electrical signal from the second feed via 22.

The first feed via 21 and the second feed via 22 are connected to an electrical element (not shown) disposed under the ground layer 201 by penetrating the ground layer 201 through the first through-hole 31 and the second through-hole 32 formed in the ground layer 201, thereby receiving and transmitting the electrical signal.

The first feed via 21 among the first feed via 21 and the second feed via 22 may transmit the electrical signal to the first antenna patch 110, and the second feed via 22 may transmit the electrical signal to the second antenna patch 120 without being in contact with the first antenna patch 110 through the through-hole 11 formed in the first antenna patch 110.

The ground pattern 400*c* disposed adjacent to the first feed via 21 is connected to the ground layer 201 and acts as a movement passage for unnecessary frequency components by coupling with the first feed via 21, thereby removing or reducing the noise frequency component.

If the electrical signal is transmitted to the first feed via 21 and the second feed via 22, the electrical signal is transmitted to the first antenna patch 110 and the second antenna patch 120 through the first feed via 21 and the second feed via 22, and the first antenna patch 110 and the second antenna patch 120 cause the resonance with the ground layer 201, thereby receiving and transmitting the RF signal. In this case, the third antenna patch 130 may improve the gain and bandwidth of the RF signal of the antenna apparatus 100 through the additional coupling with the first antenna patch 110 and the second antenna patch 120.

For example, the antenna apparatus 200 may transmit and receive the low frequency RF signal through the electrical signal transmitted from the first feed via 21 and may transmit and receive the high frequency RF signal through the electrical signal transmitted from the second feed via 22. In this way, the antenna apparatus 200 may transmit and receive the multi-band RF signals.

According to the antenna apparatus 200 of the example embodiments described herein, by including the ground pattern 400*c* disposed adjacent to the first feed via 21 transmitting the electrical signal for transmitting and receiving the low frequency RF signal to form the parasitic resonance by the coupling of the first feed via 21 and the ground pattern 400*c*, the harmonics component of the low frequency RF signal is transmitted to the ground layer 201, thereby removing or reducing the harmonics component of the low frequency RF signal that may cause the interference to the high frequency RF signal.

Referring to FIG. 9, the ground pattern 400*c* includes a coupling part 40*c*1 disposed at a side of the power supply line 21*a*, a grounding part 40*c*2 connected to the ground layer 201, and a connection part 40*c*3 connecting the coupling part 40*c*1 and the grounding part 40*c*2. By adjusting the interval d3 between the coupling part 40*c*1 of the ground pattern 400*c* and the first feed via 21, and the length R3 and the width W3 of the coupling part 40*c*1 of the ground pattern 400*c*, the frequency band of the parasitic resonance component between the first feed via 21 and the ground pattern 400*c* may be adjusted, and accordingly, the parasitic resonance component between the first feed via 21 and the ground pattern 400*c* may be matched with the resonance frequency band generated between the second antenna patch 120 and the ground layer 201 by the high frequency electrical signal applied to the second feed via 22.

Again, referring to FIG. 7 and FIG. 8, the height of the ground pattern 400*c* disposed adjacent to the first feed via 21 based on the ground layer 201 is lower than the height of the first antenna patch 110 above the ground layer 201, and the ground pattern 400*c* is disposed to vertically overlap the first antenna patch 110.

Accordingly, without increasing the size of the antenna apparatus 200, the ground pattern 400*c* is coupled to the first feed via 21 to form the resonance component of the frequency matched with the harmonics component, thereby removing or reducing the interference.

In the illustrated example embodiments, the dielectric layer 101 includes four dielectric layers 101*a*, 101*b*, 101*c*, and 101*d* and includes three antenna patches 110, 120 and 130, but the example embodiments are not limited thereto, and it is evident that the number and the thickness of the dielectric layers, and the number and the position of the antenna patches, may be changed.

In the illustrated example embodiments, the antenna apparatus 200 includes the first antenna patch 110, the second antenna patch 120, and the third antenna patch 130, but example embodiments are not limited thereto, and it is evident that the number of antenna patches, and the planar shape and the size of the antenna patches, may be changed according to the frequency characteristic of the antenna apparatus.

In the illustrated example embodiments, the first feed via 21 is connected to the first antenna patch 110 and the second feed via 22 is connected to the second antenna patch 120, but the example embodiments are not limited thereto, and the first feed via 21 and the second feed via 22 may be spaced apart from the first antenna patch 110 and the second antenna patch 120, and the electrical signal may be transmitted by coupling with the first antenna patch 110 and the second antenna patch 120.

Figure 10:
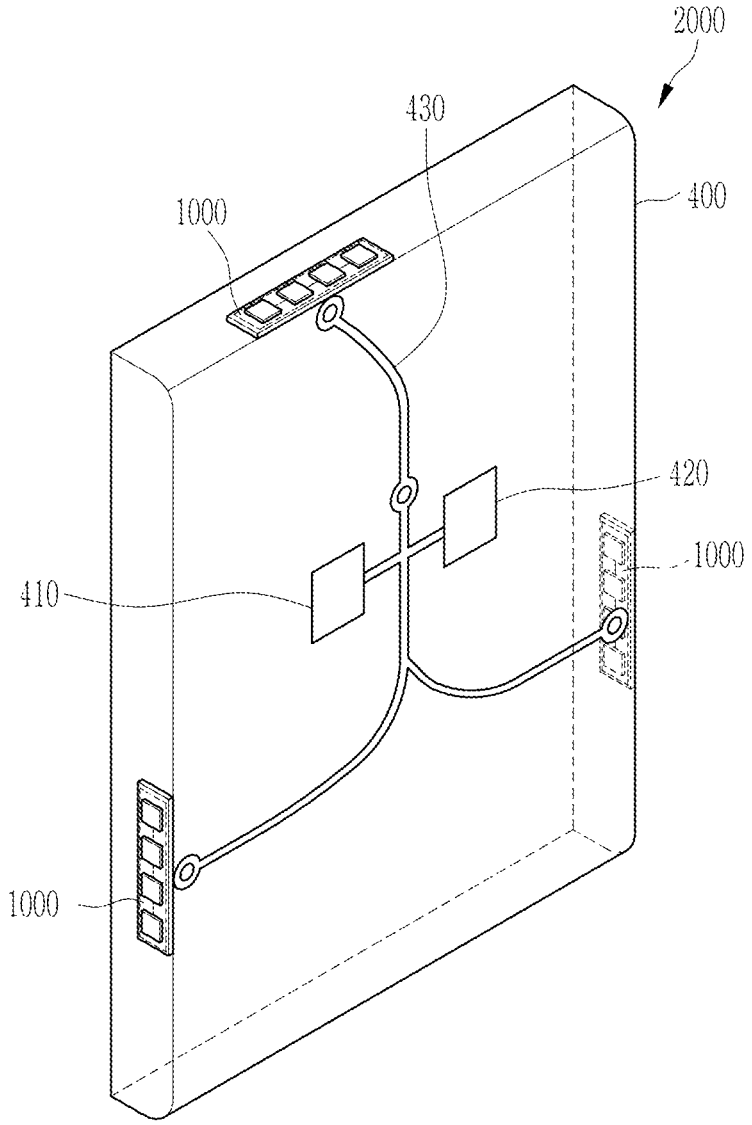
FIG. 10 is a schematic view showing an electronic device including an antenna apparatus according to one or more example embodiments.

Now, an electronic device 2000 including the antenna apparatus according to one or more example embodiments is briefly described with reference to FIG. 10. FIG. 10 is a schematic view showing an electronic device including an antenna apparatus according to one or more example embodiments.

Referring to FIG. 10, the electronic device 2000 according to one or more example embodiments includes an antenna apparatus 1000, and the antenna apparatus 1000 is disposed on a set substrate 400 of the electronic device 2000.

The electronic device 2000 may be a smart phone, a personal digital assistant, a digital video camera, a digital still camera, a network system, a computer, a monitor, a tablet, a laptop, a netbook, a television, a video game, a smart watch, an automotive part, and the like, but it is not limited thereto.

The electronic device 2000 may have polygonal sides, and the antenna apparatus 1000 may be disposed adjacent to at least a portion of a plurality of sides of the electronic device 2000.

A communication module 410 and a baseband circuit 420 may be disposed on the set substrate 400, and the antenna apparatus 1000 may be electrically connected to the communication module 410 and the baseband circuit 420 through a coaxial cable 430.

The communication module 410 may include at least one among a memory chip such as a volatile memory (e.g., a DRAM), a non-volatile memory (e.g., a ROM), a flash memory to perform digital signal processing, an application processor chip such as a central processor (e.g., a CPU), a graphics processor (e.g., a GPU), a digital signal processor, an encryption processor, a microprocessor, a microcontroller, a logic chip such as an analog-digital converter, and an application-specific IC (ASIC).

The baseband circuit 420 may generate a base signal by performing analog-digital conversion, amplification of an analog signal, filtering, and frequency conversion. The base signal input and output from the baseband circuit 420 may be transmitted to the antenna apparatus through a cable. For example, the base signal may be transferred to an integrated circuit (IC) through an electrical connection structure, a core via, and wiring, and the IC may convert the base signal into an RF signal of a millimeter waveband.

Although not shown, each antenna apparatus 1000 may include a plurality of antennas, and each antenna apparatus may be similar to the antenna apparatuses 100 and 200 according to the example embodiments described above.

In the antenna apparatus according to the example embodiments described herein, interference between signals of different bands may be reduced, thereby improving performance and a capability of being down-sized.

While specific examples have been shown and described above, it will be apparent after an understanding of this disclosure that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:
a ground layer and an antenna patch overlapping via a dielectric layer therebetween;
a first feed via and a second feed via penetrating at least a portion of the dielectric layer;
a power supply line connected to the first feed via; and
a coupling pattern disposed adjacent to the power supply line and coupled with the power supply line,
wherein at least a portion of the antenna patch is disposed between the dielectric layer and the coupling pattern is disposed under the dielectric layer.

2. The antenna apparatus of claim 1, wherein
a signal of a first frequency band is received and transmitted by an electrical signal applied to the first feed via,
a signal of a second frequency band is received and transmitted by an electrical signal applied to the second feed via, and
a center frequency of the first frequency band is lower than a center frequency of the second frequency band.

3. The antenna apparatus of claim 2, further comprising
a first ground layer separated from the ground layer, and
the coupling pattern is connected to the first ground layer.

4. The antenna apparatus of claim 3, wherein
a resonance frequency caused by coupling of the power supply line and the coupling pattern is matched with the second frequency band.

5. The antenna apparatus of claim 4, wherein
the resonance frequency caused by the coupling of the power supply line and the coupling pattern is a harmonics frequency of the first frequency band.

6. The antenna apparatus of claim 3, wherein
the coupling pattern is disposed adjacent to a side of an end of the power supply line.

7. The antenna apparatus of claim 3, wherein
the coupling pattern is disposed to be parallel to the power supply line.

8. The antenna apparatus of claim 1, further comprising
a first ground layer separated from the ground layer, and
the coupling pattern is connected to the first ground layer.

9. The antenna apparatus of claim 8, wherein
a signal of a first frequency band is received and transmitted by an electrical signal applied to the first feed via,
a signal of a second frequency band is received and transmitted by an electrical signal applied to the second feed via, and
a resonance frequency caused by the coupling of the power supply line and the coupling pattern is matched with the second frequency band.

10. The antenna apparatus of claim 9, wherein
the resonance frequency caused by the coupling of the power supply line and the coupling pattern is a harmonics frequency of the first frequency band.

11. The antenna apparatus of claim 8, wherein
the coupling pattern is disposed adjacent to a side of an end of the power supply line.

12. The antenna apparatus of claim 8, wherein
the coupling pattern is disposed to be parallel to the power supply line.

13. An antenna apparatus comprising:
a ground layer and an antenna patch overlapping via a dielectric layer therebetween;
a first feed via and a second feed via penetrating at least part of the dielectric layer; and
a coupling pattern disposed at a side of the first feed via and coupled with the first feed via,
wherein a signal of a first frequency band is received and transmitted by an electrical signal applied to the first feed via, a signal of a second frequency band is received and transmitted by an electrical signal applied to the second feed via, and a center frequency of the first frequency band is lower than a center frequency of the second frequency band.

14. The antenna apparatus of claim 13, wherein
the coupling pattern is connected to the ground layer.

15. The antenna apparatus of claim 14, wherein
a resonance frequency caused by the coupling of the power supply line and the coupling pattern is matched with the second frequency band.

16. The antenna apparatus of claim 15, wherein
the resonance frequency caused by the coupling of the power supply line and the coupling pattern is a harmonics frequency of the first frequency band.

17. The antenna apparatus of claim 14, wherein
a height of the first feed via is greater than a height of the ground layer based on the coupling pattern.

18. The antenna apparatus of claim 13, wherein
a resonance frequency caused by the coupling of the power supply line and the coupling pattern is matched with the second frequency band.

19. The antenna apparatus of claim 18, wherein the resonance frequency caused by the coupling of the power supply line and the coupling pattern is a harmonics frequency of the first frequency band.

20. The antenna apparatus of claim 13, wherein a height of the first feed via is greater than a height of the ground layer based on the coupling pattern.

* * * * *